US008074576B2

(12) United States Patent
Farooq

(10) Patent No.: US 8,074,576 B2
(45) Date of Patent: Dec. 13, 2011

(54) COMMUTER TRAIN FERRY SYSTEM FOR COMMUTERS AND THEIR VEHICLES

(76) Inventor: Anwar Farooq, Montclair, CA (US)

( * ) Notice: Subject to any disclaimer, the term of this patent is extended or adjusted under 35 U.S.C. 154(b) by 330 days.

(21) Appl. No.: 12/251,199

(22) Filed: Oct. 14, 2008

(65) Prior Publication Data

US 2010/0089282 A1 Apr. 15, 2010

(51) Int. Cl.
*B61D 3/00* (2006.01)
*B61B 1/00* (2006.01)
*B60B 17/00* (2006.01)

(52) U.S. Cl. ..... 104/27; 104/29; 105/355; 105/1.4; 414/809; 414/373

(58) Field of Classification Search ..... 104/27, 104/29, 30, 31; 105/458, 455, 404, 355, 105/4.1, 1.4, 183, 215.1; 410/26, 27, 28, 410/1, 44, 45; 14/69.5, 71.1, 72.5; 414/809, 414/812, 577, 537, 522, 373, 347, 340, 339, 414/334

See application file for complete search history.

(56) References Cited

U.S. PATENT DOCUMENTS 3,173,382 A * 3/1965 Ryan ..... 410/11
3,370,311 A * 2/1968 Demos ..... 14/69.5
3,503,340 A * 3/1970 Warren ..... 410/24
3,584,584 A 6/1971 Milenkovic
3,892,188 A 7/1975 Warren
3,933,258 A 1/1976 Forsyth
4,397,496 A 8/1983 Drygas, III
5,295,442 A * 3/1994 Carpenter ..... 105/176
6,241,308 B1 6/2001 Gaspard, II et al.
6,336,676 B2 1/2002 Gaspard, II et al.
6,363,857 B1 4/2002 Kauffman
6,443,683 B2 9/2002 Randak
6,830,417 B2 12/2004 Deets
7,275,901 B2 10/2007 Carroll
2006/0027133 A1 2/2006 Suematsu

FOREIGN PATENT DOCUMENTS

FR 2702747 * 3/1993

* cited by examiner

*Primary Examiner* — Mark Le
(74) *Attorney, Agent, or Firm* — Ariel S. Bentolila; Bay Area IP Group, LLC

(57) ABSTRACT

A commuter train ferry system includes a train engine. A plurality of boxcars is joinable to each other and to the train engine to form the commuter train ferry. Each of the boxcars includes a plurality of decks for transporting a plurality of vehicles and their occupants during a commuter trip. At least one ramp includes a plurality of driving surfaces for accessing the plurality of decks for loading and unloading the vehicles and their occupants from the boxcars where the occupants of the vehicles load and unload the vehicles from the boxcars and remain within the vehicles for at least a part of the commuter trip.

16 Claims, 6 Drawing Sheets

COMMUTER TRAIN FERRY SYSTEM FOR COMMUTERS AND THEIR VEHICLES

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to trains. More particularly, the invention relates to a commuter train ferry system that carries commuters and their vehicles.

BACKGROUND OF THE INVENTION

Currently there are too many cars on the freeway causing problems such as road congestion and accidents. Furthermore, drivers are not cooperating with the concept of carpooling, and carpooling has failed to reduce traffic on freeways in a measurable way. A large number of people insist on driving their cars to work so they can control when they leave their work and where they go after. This car dependency causes horrendous traffic jams with severe side effects such as traffic deaths, reduced productivity due to fatigue, pollution, wasted fuel on long commutes and while stuck in traffic, financial drain due to the high cost of fuel, inhalation of smog that causes long-term health problems, and wasted money on car wear and tear.

Present-day solutions to these traffic issues are not effective. Firstly, carpool lanes have been added to roads at enormous cost; however, this idea has been unsuccessful in reducing traffic jams. Also, in some areas metro trains are used to carry passengers along major freeways. However, the use of these trains requires people to leave their cars and solely depend on public transportation, which most commuters resist. The result is that metro trains and rail lines are under utilized and therefore not very effective in reducing traffic.

In another currently known solution, Amtrak has a system called Auto Train that carries both passengers and drivers long distances (e.g., 855 miles one-way) on the East Coast between Lorton, Va. and Sanford, Fla. In this system half of the train is designed for passengers and the other half of the train carries the passenger's empty vehicles in racks. However, this solution is exclusively used for long distance travel where the drivers at the end of their trips have their vehicles available to them. In this system the drivers and passengers are kept separated from their vehicles during the trip and reunited afterwards. For short-term trips lasting one, two or three hours this system is ineffective, inefficient and impractical as it would require long delays at each station for loading/unloading passengers and their vehicles separately as at each stop. The way the present system works right now, each box car would be separated from the train and ramps attached and vehicles loaded/unloaded and then joined together with the train In view of the foregoing, there is a need for improved techniques for reducing traffic on the roadways with a system that is practical for daily commutes where commuters are able to remain with their vehicles.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A is a front view of a ramp truck, and FIG. 2B is a top view of ramp trucks next to a boxcar;

Figure 1:
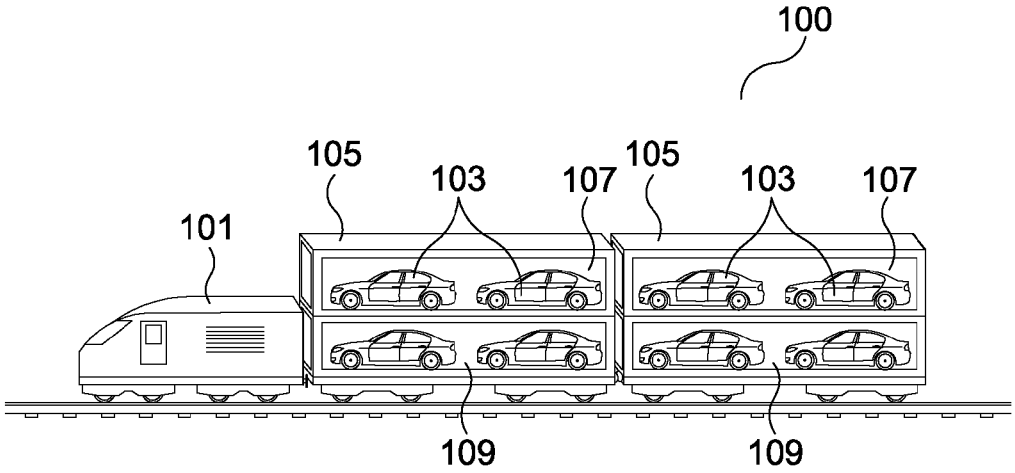
FIG. 1 illustrates an exemplary commuter train ferry system, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a commuter train ferry system for commuters and their vehicles is presented.

In one embodiment, a commuter train ferry system includes a plurality of boxcars joinable to each other to form a train. Each of the boxcars includes a plurality of decks configurable for transporting a plurality of vehicles and their occupants during a commuter trip. At least one ramp is configurable for loading and unloading the vehicles with their occupants from the boxcars. In other embodiments the at least one ramp includes a plurality of driving surfaces for accessing the plurality of decks, the ramp is joined to a truck for moving the ramp to dock with a one of the boxcars and the ramp provides a substantially ninety degree turn for accessing the decks. In another embodiment the occupants of the vehicles can load and unload the vehicles from the boxcars and can remain within the vehicles for at least a part of the commuter trip. In still other embodiments the vehicles can be loaded into the boxcars parallel to sides of the boxcars and the vehicles can pass between adjacent boxcars during loading and unloading. In a further embodiment the vehicles can be loaded into the boxcars perpendicular to sides of the boxcars. In yet other embodiments the boxcars can travel along four parallel rails where an inner two of the four parallel rails are positioned at a standard width railroad track and the boxcars further includes axels with four wheels for riding on the four parallel rails. In still another embodiment the boxcars are further configurable for transporting freight having a width wider greater than what can be transported on the standard width railroad track.

In another embodiment a commuter train ferry system includes means for transporting a plurality of vehicles and their occupants during a commuter trip and means for loading and unloading the vehicles with their occupants from the transporting means.

In another embodiment a commuter train ferry system includes a train engine. A plurality of boxcars is joinable to each other and to the train engine to form the commuter train ferry. Each of the boxcars includes a plurality of decks for transporting a plurality of vehicles and their occupants during a commuter trip. At least one ramp includes a plurality of driving surfaces for accessing the plurality of decks for loading and unloading the vehicles and their occupants from the boxcars where the occupants of the vehicles load and unload the vehicles from the boxcars and remain within the vehicles for at least a part of the commuter trip. In other embodiments the ramp is joined to a truck for moving the ramp to dock with a one of the boxcars and the ramp provides a substantially ninety-degree turn for accessing the decks. In further embodiments the vehicles are loaded into the boxcars parallel to sides of the boxcars and the vehicles can pass between adjacent boxcars during loading and unloading. In yet other embodiments the vehicles are loaded into the boxcars perpendicular to sides of the boxcars and the boxcars travel along four parallel rails and the train engine rides on an inner two of the four parallel rails. In still another embodiment the boxcars further includes axels with four wheels for riding on the four parallel rails.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Preferred embodiments of the present invention provide a solution using present day technology to unclog freeways and other roadways that may be implemented in a short amount of time at a low cost. The benefits of preferred embodiments of the present invention include, without limitation, the following. Preferred embodiments have the potential to make a significant dent in traffic related problems and provide more pleasant, environmentally friendly commutes that may save lives, save money, save time, and save wear and tear on cars. Preferred embodiments require building no new freeways or other roadways and have the potential to reduce traffic on present-day freeways by 40% to 50% or more, once fully implemented. Maybe most importantly, preferred embodiments are environmentally friendly and may reduce our reliance on foreign oil.

Preferred embodiments of the present invention have the potential to generally eliminate traffic jams on the most heavily traveled freeways in a very short time, eliminate the need for carpool lanes, which may enable present carpool lanes to be available to regular traffic thus further reducing the traffic on freeways (carpool lanes could also be adapted for this system by laying railroad tracks over them), eliminate the need for transforming carpool lanes into toll lanes as recently proposed to tackle the traffic jam problem, and generally eliminate the need to widen freeways. Preferred embodiments may cut enormous amount of time spent commuting, for example, without limitation, a three-hour rush-hour commute may be reduced to a half hour pleasant commute. By providing a shorter more pleasant commute, preferred embodiments may help increase productivity by reducing stress and fatigue; reduce smog on a major scale, and save enormous amount of gasoline. Preferred embodiments also enable people to remain in their beloved cars. Furthermore, preferred embodiments of the present invention may be adopted worldwide.

A preferred embodiment of the present invention provides a commuter train ferry systems where commuters ride in their vehicles on a train similarly to how a ferry carries drivers and their vehicles across bodies of water. Currently, trains have not been used to carry vehicles where drivers and passengers stay in their vehicles. One reason is that trains are looked upon as long distance carriers rather than short distance carriers. However, preferred embodiments of the present invention employ the use of trains for short distances. Since the average commute is about two to three hours during which time drivers and passengers normally stay in their vehicles and since on these relatively short commutes commuters typically do not need to eat, sleep or use the bathroom, it is not an inconvenience for commuters to stay in their vehicles while the train carries them. Also, preferred embodiments of the present enable commuters to have access to their vehicles on both ends of the commute.

FIG. 1 illustrates an exemplary commuter train ferry system 100, in the present embodiment a train engine 101 is used to haul vehicles 103 along with their passengers in specially designed boxcars 105. Vehicles 103 that fit onto boxcars 105 are typically cars and small pickup trucks. However, smaller vehicles such as, but not limited to, motorcycles, motorized scooters, smart cars, etc. may also be carried by boxcars 105. Alternate embodiments may be implemented with larger boxcars or with boxcars that carry fewer vehicles at a time that may accommodate larger vehicles. Train engine 101 is preferably an electric engine to add to the environmentally friendly aspect of commuter train ferry system 100; however, other types of engines such as, but not limited to, diesel engines may also be used. In the present embodiment, passenger vehicles 103 are hauled by commuters themselves in boxcars 105, and drivers and passengers remain inside vehicles 103 during the entire duration of the commute in much the same way as ferries carry vehicles with passengers across bodies of water in many places.

In typical use of the present embodiment, each boxcar 105 holds twenty passenger vehicles, ten passenger vehicles on an upper deck 107 and ten passenger vehicles on a lower deck 109, and a typical train preferably has ten boxcars or more. Therefore, each train may carry approximately two hundred passenger vehicles. However, a larger number of smaller vehicles such as, but not limited to, motorcycles or smart cars may be carried in boxcars 105. Furthermore, alternate embodiments may be implemented to carry more or fewer vehicles. During rush hour, trains may be lined up one behind the other and as soon as one train leaves, another train takes its place to load another two hundred passenger vehicles. In a non-limiting example, if these trains operate every fifteen minutes during rush hours, every hour the trains would carry eight hundred cars. During a typical four-hour morning rush period, for example, without limitation, from 4:00 AM to 8:00 AM, these trains could remove 3,200 vehicles from the freeway and another 3,200 vehicles during a typical evening rush hour. Although rush hours would probably see the greatest use, these trains can run all day. In some cases, two trains may simultaneously run on two different tracks, where available, to double the number of cars that may be removed from rush hour traffic. If charges to carry vehicles aboard the trains are reasonably low, for example, without limitation, by using state subsidies, commuters may prefer this solution to current solutions, and commuter train ferry system 100 may become enormously popular and thus very effective in reducing traffic jams.

Limits may be placed on the size of vehicles 103 allowed onto the train depending on the size of boxcars 105, and some embodiments may comprise an automatic vehicle dimension check system to help speed loading of vehicles onto the trains in the most efficient way. In an exemplary vehicle dimension check system, vehicles to be loaded onto the train pass through an invisible "door" that checks the dimensions of the vehicles to determine suitability for boarding the train. Vehicles that fail the test are not allowed on the train. In the present embodiment, vehicle dimension check system comprises light emitting diode (LED) lights with reflectors opposite the LEDs on the "door". The "door" is comprised of three LED beams, left, right and top, and any vehicle that can pass through the "door" without breaking the LED beams are allowed to board the train. Vehicles that are too broad or too tall to fit inside boxcars 105 will break one or more of the LED beams, thus triggering an alarm. These vehicles are not allowed to board the train.

Those skilled in the art, in light of the present teachings, will readily recognize that a multiplicity of suitable systems for determining if a vehicle will fit on the train may be implemented in various embodiments of the present invention. For example, without limitation, in some embodiments laser beams may be used instead of LED beams, and other embodiments may employ physical barriers such as, but not limited to, plastic bars, rather than light beams. Another system could be based upon photodetector with transmitter and a receiver, or based on infrared beam In yet other embodiments, the size of the vehicle or certain dimensions of the vehicle may not be an issue for fitting onto the boxcar. For example, without limitation, in some embodiments, the boxcar may be designed so that the width of the vehicle does not matter, and therefore only the height of the vehicle is checked before the vehicle may be loaded onto the train. In other embodiments the weight of the vehicle may be more important than the size of the vehicle, and in these embodiments the vehicle may be weighed on a scale before being loaded onto the train. In yet other embodiments, the dimensions and weight may both be factors so the vehicle check system in these embodiments may comprise dimension checking means and a scale. Some embodiments may be implemented without vehicle dimension check systems by pre-screening the vehicles before boarding.

Figure 2A:
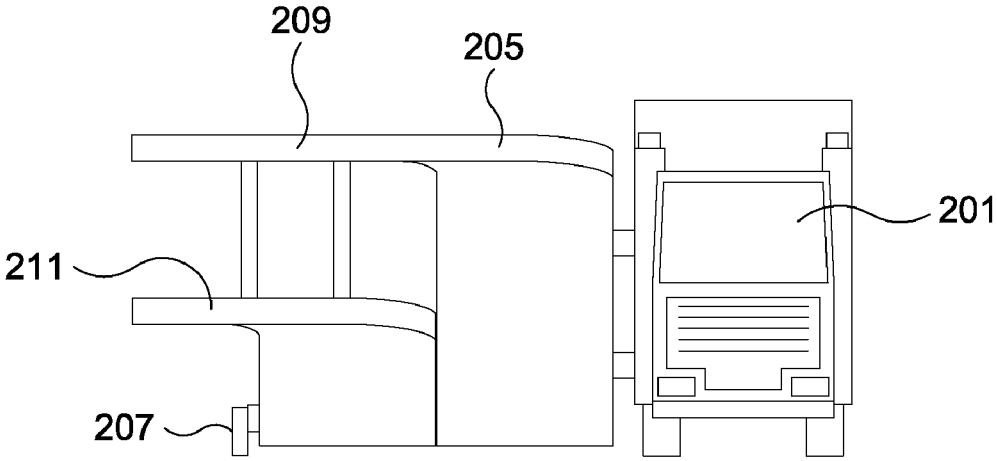
FIGS. 2A and 2B illustrate exemplary ramp trucks for loading a commuter train ferry system, in accordance with an embodiment of the present invention.
Figure 2B:
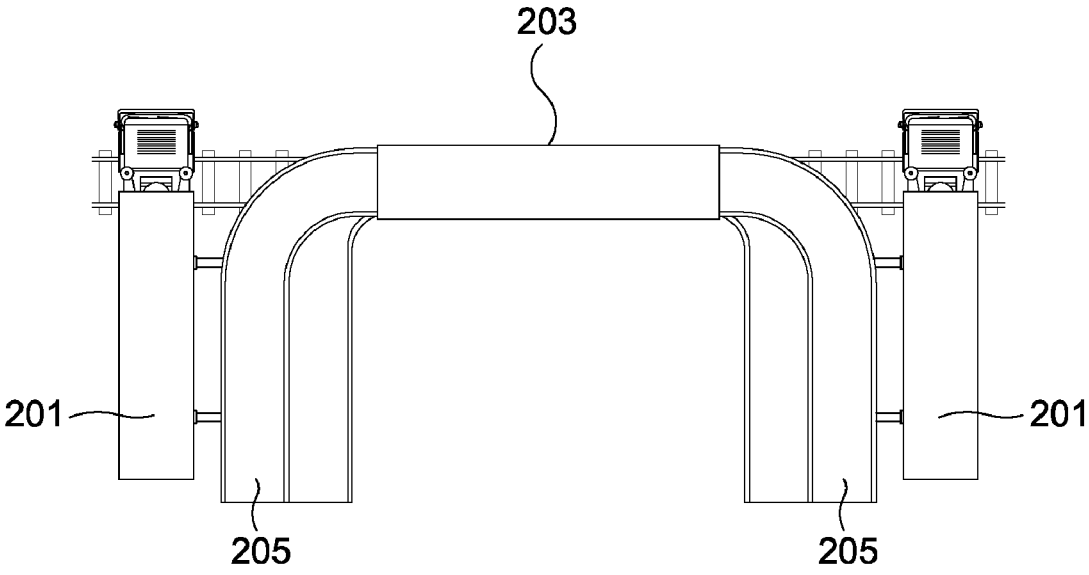
Figure 4:
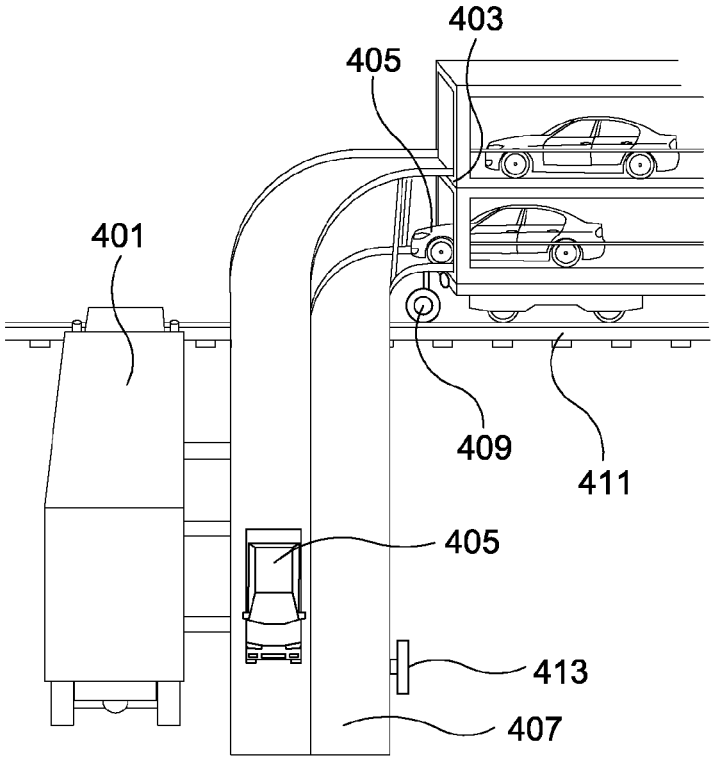
FIG. 4 illustrates an exemplary ramp truck loading a boxcar in a commuter train ferry system, in accordance with an embodiment of the present invention.

FIGS. 2A and 2B illustrate exemplary ramp trucks 201 for loading a commuter train ferry system, in accordance with an embodiment of the present invention. FIG. 2A is a front view of ramp truck 201, and FIG. 2B is a top view of ramp trucks 201 next to a boxcar 203. Ramp trucks 201 comprise built-in ramps 205 that dock at the front and back of the train for loading and unloading of commuter vehicles. In the present embodiment, ramp 205 comprises a rigid frame and two driving surfaces. For durability and strength, it is preferable that the ramps on ramp trucks be built of steel as tow-truck ramps are built today along with hydraulic controls. A wheel 207 aids in moving ramps 205 with ramp trucks 201 by rolling along the ground next to ramp truck 201 and to give strength to the structure. In alternate embodiments, the ramps may comprise multiple wheels. In the present embodiment, ramps 205 are designed with a roughly ninety-degree angle for increased portability and to save space. However, in alternate embodiments ramps may be configured with various different angles, for example, without limitation, ramps 407 shown by way of example in FIG. 4 are angled less than ninety degrees. In the present embodiment, ramp 205 of ramp truck 201 comprises an upper ramp 209 and a lower ramp 211 so that vehicles may reach either the upper or the lower level of boxcar 203. However, in alternate embodiments the ramp trucks may comprise only one ramp each. In these embodiments two ramp trucks would be used at each end of the boxcar, one ramp truck with a lower ramp and another truck with an upper ramp. These two ramp trucks may be positioned at the end of the boxcar simultaneously by placing one ramp truck on each side of the boxcar or the ramp trucks may take turns docking with the boxcar.

Figure 3:
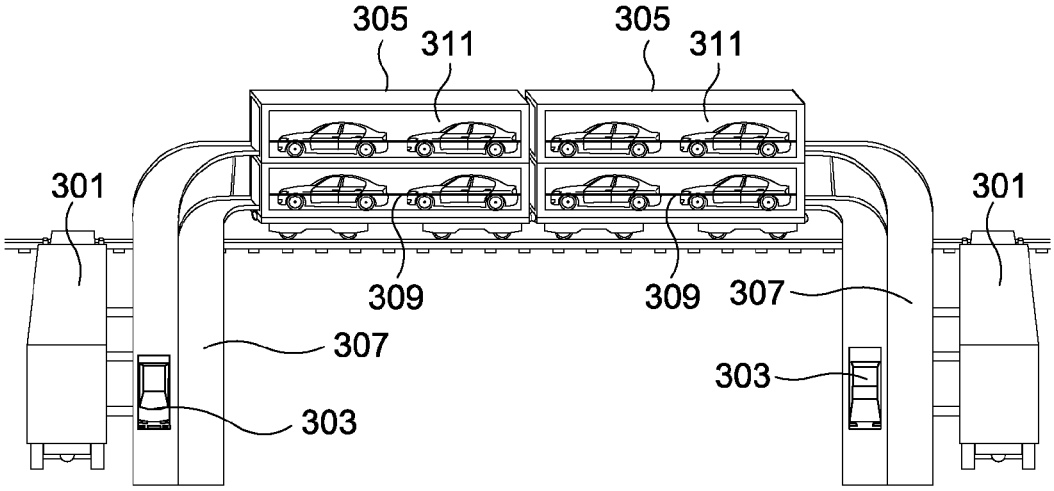
FIG. 3 illustrates exemplary ramp trucks loading and unloading vehicles onto boxcars in a commuter train ferry system, in accordance with an embodiment of the present invention.

Those skilled in the art, in light of the present teachings, will readily recognize that a multiplicity of suitable methods exist for maneuvering ramps up to boxcars in commuter train ferry systems in alternate embodiments. For example, without limitation, in one embodiment ramps on wheels may be towed up to the boxcars using various means such as but not limited to, trucks, tractors, train engines, mechanical pulley systems, etc. In another exemplary embodiment, ramps may travel along the tracks so that the ramps may be rolled up to the boxcars along the track as shown by way of example in FIG. 4. In yet another embodiment, ramps located on the side of the tracks may rotate into position to dock with boxcars when the boxcars are on the track and then rotate away from the tracks once the boxcars are loaded. Ramps may also be built-in the boxcars and could be extended outwards onto the ground in the same way that moving trucks have built-in ramps FIG. 3 illustrates exemplary ramp trucks 301 loading and unloading vehicles 303 onto boxcars 305 in a commuter train ferry system, in accordance with an embodiment of the present invention. In the present embodiment, commuters drive vehicles 303 onto ramps 307 attached to ramp trucks 301 into boxcars 305 and continue driving inside boxcars 305, from boxcar to boxcar, until they reach the most forward empty parking spot inside boxcars 305. Passengers are then allowed to stay inside vehicles 303 or passengers may be allowed to come out of vehicles 303 and hold a railing 309 along windows 311 in boxcars 305 to enjoy the scenery. Some embodiments may include a passenger boxcar with features such as, but not limited to, benches, chairs, vending machines, concessions, etc. that the commuters may ride in during the trip if they so desire. Other vehicles follow the same pattern, until the train is full or all vehicles are accommodated.

At this point, ramp trucks 301 undock, a train engine attaches to the front of boxcars 305 and the train moves on to the next destination. At a destination, the engine separates from the train and two ramp-trucks 301 dock onto boxcars 305 of the train at both ends. The vehicles that are on the trains can unload at this point using ramp truck 301 at the front of the train while simultaneously return-trip vehicles can board the train using ramp-truck 301 at the back of the train. Depending on the size of a train, the train may be able to unload and load in less than fifteen minutes and quickly make a round trip. The loading and unloading process in the present embodiment enables commuters to drive their own cars onto and off of the trains.

Commuter train ferry systems according to the present embodiment are more efficient as an express train between origin and destination with no stops. However, stops can be accommodated. To pick up vehicles at other stops, the empty space in the back of the train, if available, is utilized. For vehicles that need to disembark at a specific stop, these vehicles must be sorted at the point of origin and allowed to load in order of the stops made by the train. The engine must separate and the ramp-trucks must dock before the vehicles can disembark.

In the present embodiment, the commuter train ferry system allows the flexibility to add or reduce the number of boxcars 305 that are hauled by the train engine without any change in infrastructure due to the portable nature of ramps 307 by utilizing ramp-trucks 301. The system is designed to be put into operation in a year or less at minimum cost and with minimum infrastructure. Permanent structures such as, but not limited to, stations with permanent ramps may be built later, if desired.

FIG. 4 illustrates an exemplary ramp truck 401 loading a boxcar 403 in a commuter train ferry system, in accordance with an embodiment of the present invention. Vehicles 405 are loaded onto boxcar 403 with a ramp 407. In the present embodiment ramp 407 comprises wheels 409 and 413 that roll along a substantially flat surface next to tracks 411. In typical use of the present embodiment, ramp 407 is positioned on a side track, and when the train arrives, ramp truck 401 drives ramp 407 along the side track onto tracks 411 behind boxcar 403. In some applications, it is optimal for the ground to be prepared along the tracks in the vicinity of a train station such that the tracks are level with the ground as at most rail-road crossings. The ramps would have hydraulic controls (much the same way as most tow-trucks have hydraulic controls) that would allow the ramp to be adjusted to be aligned with the box car for easy loading and unloading of commuter vehicles).

Another preferred embodiment is described in the following. The present embodiment has some benefits over the embodiments previously described by way of example in reference to FIGS. 1 through 4. However, the present embodiment requires more time and changes to existing infrastructure to implement. The present embodiment is able to carry three times the number of vehicles per train as compared to the embodiments previously described. Also, the loading and unloading of vehicles is fast and easy, for example, without limitation, loading and unloading a whole train can be accomplished in five minutes. The present embodiment also enables the trains to make as many frequent stops as needed to both load and unload vehicles, without the need to separate the engine from the boxcars. The design of the present embodiment enables the trains to be more stable and less prone to derailment, potentially raising public confidence in the system. The ability to carry more vehicles with the present embodiment makes the present embodiment more eco-friendly by reducing more smog per train by carrying more vehicles per train and is therefore more cost effective and efficient.

Figure 5:
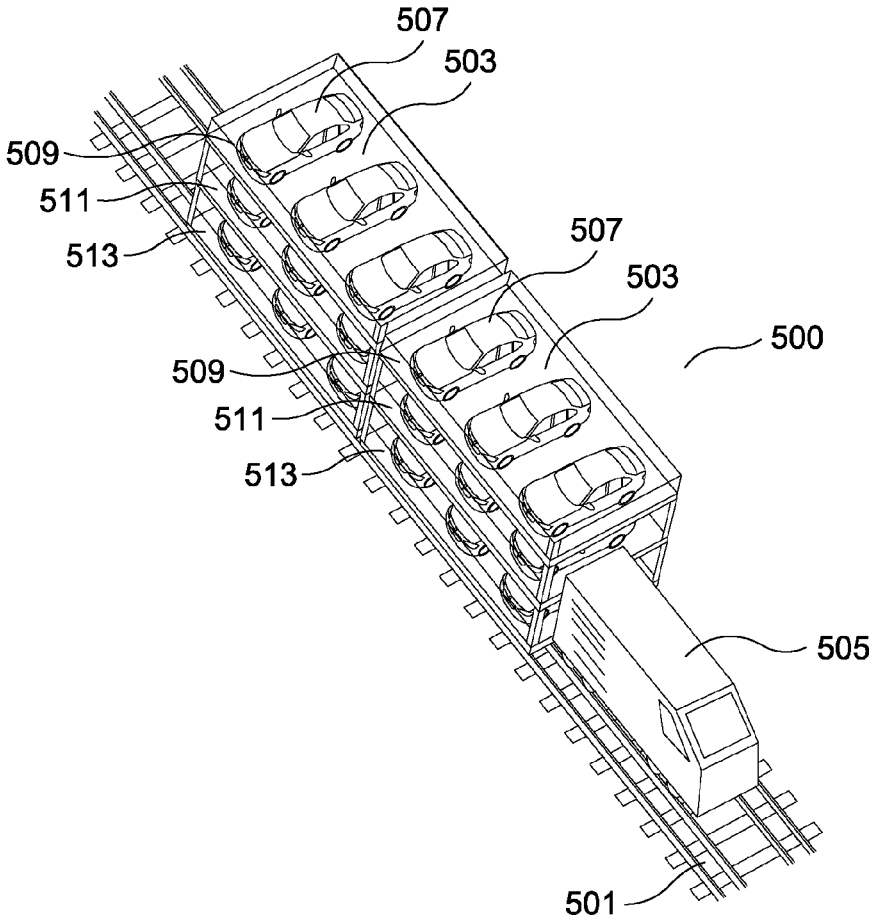
FIG. 5 illustrates an exemplary commuter train ferry system using multiple tracks, in accordance with an embodiment of the present invention.

FIG. 5 illustrates an exemplary commuter train ferry system 500 using multiple tracks 501, in accordance with an embodiment of the present invention. It is striking to see how narrow present-day trains actually are. These trains look out of proportion between the height and width of the boxcars on the trains. However, since the design of tracks and trains is centuries old and an infrastructure has been built around this design, it is hard to imagine any other way even if another way is technically possible. In the present embodiment, a new kind of tracks 501 would be laid along special routes. Tracks 501 are a four-track system rather than the present-day two-track system. An inner set of two tracks are the same dimensions as present-day tracks to accommodate a conventional train engine 505 and to enable regular trains to use tracks 501 during off use of commuter train ferry system 500. A wider boxcar 503 rides on these four tracks 501 with axels that have four wheels, with two inner wheels that ride on the inner set of tracks along with train engine 505 and two outer wheels that ride on an outer set of tracks. Both inner and outer tracks are used by boxcars 503 that are wide enough to carry typical passenger vehicles 507 sideways or perpendicular to train engine 505. This enables approximately three times the number of vehicles 507 to be carried per boxcar 503 than can be carried in boxcars of conventional size. In the present embodiment, boxcars 503 have three decks, an upper deck 509, a mid deck 511 and a lower deck 513. However, in alternate embodiments, the boxcars may comprise more or fewer decks. Train stations may be built for use with commuter train ferry system 500 with three tier platforms that are parallel to and align with each deck of boxcars 503 to enable commuter vehicles 507 to load and unload quickly and seamlessly onto and off of decks 509, 511 and 513 of boxcars 503.

A vehicle dimension check system may be implemented in the present embodiment to verify that vehicles 507 attempting to board the train do not exceed the maximum allowable size. Since vehicles 507 are loaded onto boxcar 503 perpendicularly to train engine 505, the length of vehicles 507 may be a more important measurement than the width or height of vehicles 507 in the present embodiment. Therefore, if a vehicle dimension check system is implemented, it may comprise means for measuring the length of vehicles 507 as well as other dimensions such as, but not limited to, height, width and weight. Those skilled in the art, in light of the present teachings, will readily recognize that a multiplicity of suitable measurement means may be used in vehicle dimension check systems. For example, without limitation, in one embodiment, a vehicle dimension check system using LEDs and reflectors similar to the system described by way of example in reference to FIG. 1 may be implemented. In other embodiments, various other types of measurement means and combinations of measurement means may be implemented such as, but not limited to, lasers, scales, physical barriers, etc. In yet other embodiments, no vehicle dimension check systems may be implemented.

In the present embodiment, each deck accommodates approximately twenty vehicles 507 parked sideways, for a total of sixty vehicles 507 per boxcar 503. Alternate embodiments may comprise larger or smaller boxcars to carry more or fewer vehicles. In the present embodiment, a train with ten boxcars would be able to carry approximately six hundred vehicles 507. Trains leaving every ten minutes due to fast loading and unloading of vehicles 507 could carry 3,600 cars per hour, and during a four-hour rush period, would be able to remove 14,400 vehicles from traffic during morning rush hour per track 501 and an additional 14,400 cars during evening rush hour. To remove even more commuter vehicles from traffic, multiple trains can simultaneously run on parallel tracks in some embodiments.

Figure 6:
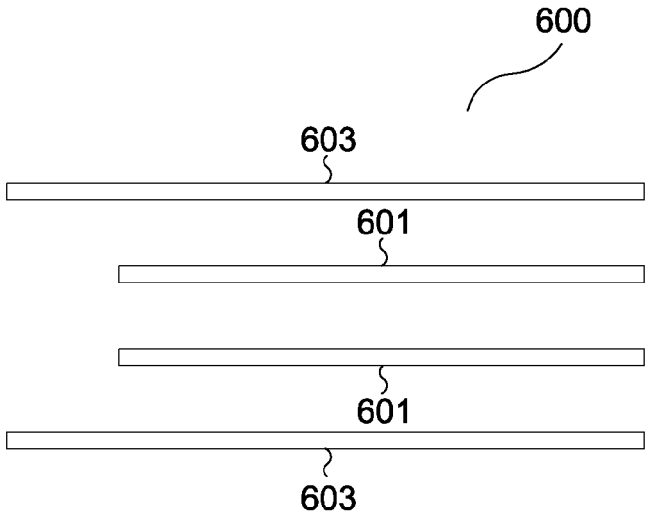
FIG. 6 is a top view of exemplary tracks for use with a commuter train ferry system with widened boxcars, in accordance with an embodiment of the present invention.

FIG. 6 is a top view of exemplary tracks 600 for use with a commuter train ferry system with widened boxcars, in accordance with an embodiment of the present invention. In the present embodiment, tracks 600 comprise inner tracks 601 and outer tracks 603. Inner tracks 601 are four feet and eight and a half inches (1435 mm) apart, which is the standard width for railroad tracks. Outer tracks 603 are sixteen feet and four inches (5000 mm) apart to accommodate most medium sized sedans and small pickup trucks when parked sideways. However, in alternate embodiments the outer tracks may be wider or narrower depending on the width of the boxcars to be used on the tracks.

Tracks 600 may also be used in applications other than a commuter train ferry system. For example, without limitation, freight boxcars may be implemented for use on tracks 600 that enable trains to carry over three times the freight that can currently be carried by conventional trains. Extra wide boxcars would also be useful for carrying wide cargo that cannot be carried by conventional trains. Tracks 600 would enable trains to carry cargo that is wider than sixteen feet wide, while conventional trains cannot carry cargo wider than five feet. Some embodiments may include a passenger boxcar with features such as, but not limited to, benches, chairs, vending machines, concessions, etc. that the commuters may ride in during the trip if they so desire. Furthermore, a train using wider boxcars is more stable than a conventional train, and during a derailment, these wider boxcars will generally not flip over due to the four-wheel axel design.

Having fully described at least one embodiment of the present invention, other equivalent or alternative methods of providing a commuter train ferry system according to the present invention will be apparent to those skilled in the art. The invention has been described above by way of illustration, and the specific embodiments disclosed are not intended to limit the invention to the particular forms disclosed. For example, the particular implementation of the boxcars may vary depending upon the particular type of vehicle being carried. The boxcars described in the foregoing were directed to implementations for carrying cars and small trucks; however, similar techniques are to make implementations that can carry larger vehicles such as, but not limited to, SUVs and full-size pickup trucks. Implementations of the present invention that may carry different sizes of vehicles are contemplated as within the scope of the present invention. The invention is thus to cover all modifications, equivalents, and alternatives falling within the spirit and scope of the following claims.

What is claimed is:

1. A commuter train ferry system comprising:

a plurality of boxcars joinable to each other to form a train, each of said boxcars comprising a plurality of decks configured for transporting a plurality of vehicles and their occupants during a commuter trip;

at least one ramp configured for loading and unloading said vehicles with their occupants from said boxcars, said at least one ramp comprising a plurality of driving surfaces for accessing said plurality of decks and at least one wheel configured for rolling on a ground surface; and at least one ramp truck comprising a plurality of wheels supporting a truck body having a truck side perpendicular to the ground surface, said truck side being joined only to a side of said at least one ramp where said truck side is substantially parallel to a portion of said plurality of driving surfaces, and said at least one ramp truck is operable for an operator in said ramp truck to turn and move said at least one ramp on the ground surface in a plurality of directions to dock with one of said boxcars.

2. The commuter train ferry system as recited in claim 1, wherein said ramp provides a substantially ninety-degree turn for accessing said decks.

3. The commuter train ferry system as recited in claim 1, wherein said occupants of said vehicles can load and unload said vehicles from said boxcars and can remain within said vehicles for at least a part of said commuter trip.

4. The commuter train ferry system as recited in claim 1, wherein said vehicles can be loaded into said boxcars parallel to sides of said boxcars.

5. The commuter train ferry system as recited in claim 4, wherein said vehicles can pass between adjacent boxcars during loading and unloading.

6. The commuter train ferry system as recited in claim 1, wherein said vehicles can be loaded into said boxcars perpendicular to sides of said boxcars.

7. The commuter train ferry system as recited in claim 6, wherein said boxcars can travel along four parallel rails where an inner two of said four parallel rails are positioned at a standard width railroad track.

8. The commuter train ferry system as recited in claim 7, wherein said boxcars further comprise axles with four wheels for riding on said four parallel rails.

9. The commuter train ferry system as recited in claim 8, wherein said boxcars are further configurable for transporting freight having a wider width greater than what can be transported on said standard width railroad track.

10. A commuter train ferry system comprising:

a train engine;

a plurality of boxcars joinable to each other and to said train engine to form the commuter train ferry, each of said boxcars comprising a plurality of decks for transporting a plurality of vehicles and their occupants during a commuter trip;

at least one ramp comprising at least one wheel configured for rolling on a ground surface and a plurality of driving surfaces for accessing said plurality of decks for loading and unloading said vehicles and their occupants from said boxcars where said occupants of said vehicles load and unload said vehicles from said boxcars and remain within said vehicles for at least a part of said commuter trip; and at least one ramp truck comprising a plurality of wheels supporting a truck body having a truck side perpendicular to the ground surface, said truck side being joined only to a side of said at least one ramp where said truck side is substantially parallel to a portion of said plurality of driving surfaces, and said at least one ramp truck is operable for an operator in said ramp truck to turn and move said at least one ramp on the ground surface in a plurality of directions to dock with one of said boxcars.

11. The commuter train ferry system as recited in claim 10, wherein said ramp provides a substantially ninety-degree turn for accessing said decks.

12. The commuter train ferry system as recited in claim 10, wherein said vehicles are loaded into said boxcars parallel to sides of said boxcars.

13. The commuter train ferry system as recited in claim 12, wherein said vehicles can pass between adjacent boxcars during loading and unloading.

14. The commuter train ferry system as recited in claim 10, wherein said vehicles are loaded into said boxcars perpendicular to sides of said boxcars.

15. The commuter train ferry system as recited in claim 14, wherein said boxcars travel along four parallel rails and said train engine rides only on an inner two of said four parallel rails.

16. The commuter train ferry system as recited in claim 15, wherein said boxcars further comprise axles with four wheels for riding on said four parallel rails.

* * * * *